United States Patent [19]

Nibling

[11] 4,413,736

[45] Nov. 8, 1983

[54] JEWELRY BOX

[76] Inventor: Jerre L. Nibling, P.O. Box 277, Lavon, Tex. 75066

[21] Appl. No.: 363,057

[22] Filed: Mar. 29, 1982

[51] Int. Cl.[3] ..... A47F 5/08; A47B 67/02; B65D 25/10; B65D 5/52

[52] U.S. Cl. ..... 206/566; 206/45.11; 206/457; 206/459; 312/245

[58] Field of Search ..... 206/566, 459, 457, 45.11; 312/245

[56] References Cited

U.S. PATENT DOCUMENTS

| | | | |
|---|---|---|---|
| 939,287 | 11/1909 | Miner | 206/45.11 |
| 1,059,561 | 4/1913 | Parks | 206/45.11 |
| 1,598,384 | 8/1926 | Monzon | 206/457 |
| 2,501,694 | 5/1950 | Ruffin | 206/457 |
| 3,225,913 | 12/1965 | Lee | 206/534 |
| 3,370,702 | 2/1968 | Rosen | 206/566 |
| 3,415,407 | 12/1968 | Alden et al. | 206/459 |
| 3,930,702 | 1/1976 | Pichowicz | 206/566 |
| 4,324,446 | 4/1982 | Lesage | 206/566 |

*Primary Examiner*—William T. Dixson, Jr.
*Attorney, Agent, or Firm*—Harry C. Post, III

[57] ABSTRACT

A jewelry box comprises a container and a cover for preventing access into the container connected to the container. A frame for providing a supporting border to a representation made on a surface and for permitting a visual observation of the representation may be detachably connected to the cover so that the representation may be replaced. A hanger adapted to be connected to the container for mounting the container to a wall may also be provided and, when the container is mounted on the wall, a device is disposed within the container to suspend a necklace within the container.

16 Claims, 6 Drawing Figures

JEWELRY BOX

The use of a box to store jewelry is well known. Some examples of a jewelry box are given in U.S. Design Pat. Nos. 65,742; 167,689; 169,356; and 249,240. As shown in these patents, the typical prior art jewelry box rests on a surface; such as, a dressing table, and may be easily knocked over. The jewelry contained within these prior art jewelry boxes is mixed or in the case of a necklace is tangled, which requires a substantial period of time to recover the jewelry or untangle the necklace. Also, the typical prior art jewelry box is made of fine wood or other material to improve the appearance of the box. However, such prior art jewelry boxes fail to allow the appearance of the box to be easily changed or to be personalized to the owner of the box.

Accordingly, it is an object of the present invention to provide a jewelry box which includes a hanger structure for mounting a container on a wall to inhibit the likelihood of its being knocked over.

Further, it is an object of the present invention to provide a jewelry box which includes a frame structure detachably connected to a cover for the box to provide a supporting border to a representation made on a surface, such as, a photograph, painting or picture, to enhance the appearance of or personalize the jewelry box.

Further, it is an object of the present invention to provide a jewelry box which includes a hanger structure for mounting a container on a wall to inhibit the likelihood of its being knocked over and which includes a frame structure detachably connected to a cover for the box to provide a supporting border to a representation made on a surface to enhance the appearance of or personalize the jewelry box.

In accordance with the invention, a jewelry box, comprises, a container adapted to enclose jewelry, a cover for preventing access into the container, and apparatus to connect the cover to the container. A frame for providing a supporting border to a representation made on a surface and for permitting a visual observation of the representation is detachably connected to the cover so as to permit replacement of the representation.

Further, in accordance with the invention, a jewelry box, comprises, a container, a cover for preventing access into said container means and apparatus to connect the cover to the container. A hanger is adapted to be connected to said container for mounting the container on a wall. A device for suspending a necklace within the container is used when the container is mounted on the wall.

Further, in accordance with the invention, a jewelry box, comprises, a container, a cover for preventing access into said container means and apparatus to connect the cover to the container. A frame for providing a supporting border to a representation made on a surface and for permitting a visual observation of the representation is detachably connected to the cover so as to permit replacement of the representation. A hanger is adapted to be connected to said container for mounting the container on a wall. A device for suspending a necklace within the container is used when the container is mounted on the wall.

Other objects and advantages of the invention will become apparent upon reading the following detailed description and upon reference to the drawings, in which like reference characters and used throughout to designate like parts:

Turning now to FIGS. 1-3 and 6, there is shown a jewelry box 10 constructed according to the present invention. Jewelry box 10 comprises a container 12, a cover 14 for preventing access into container 12, and upper and lower hinge members 16 and 18, respectively, for connecting cover 14 to container 12.

Figure 1:
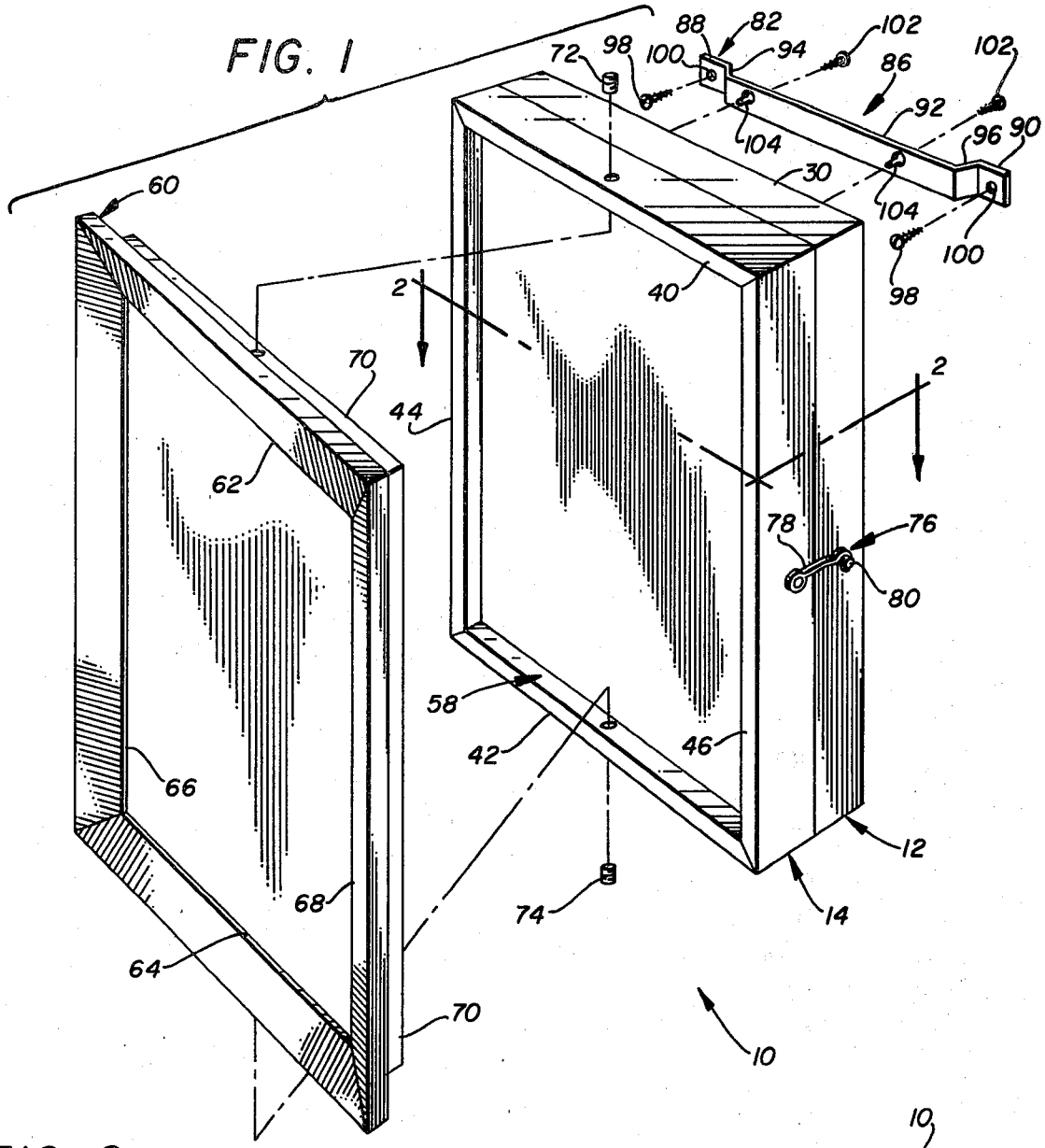
FIG. 1 is a front perspective, exploded view of a jewelry box constructed according to the present invention.
Figure 2:
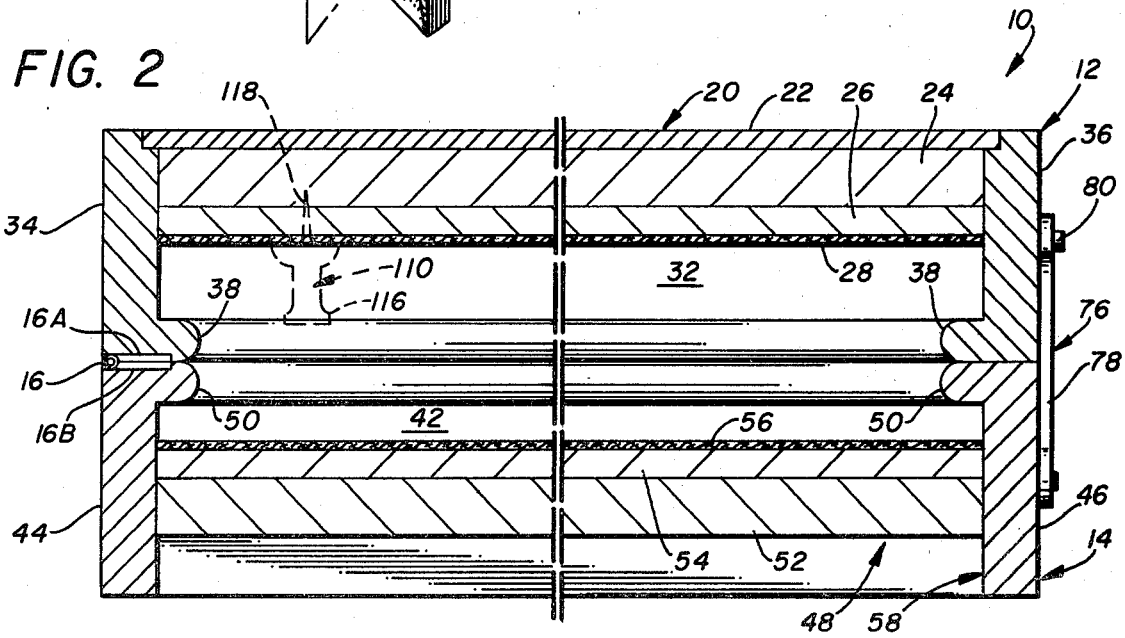
FIG. 2 is a cross-sectional view of the invention shown in FIG. 1, taken along the lines 2—2 in the direction of the arrows.
Figure 3:
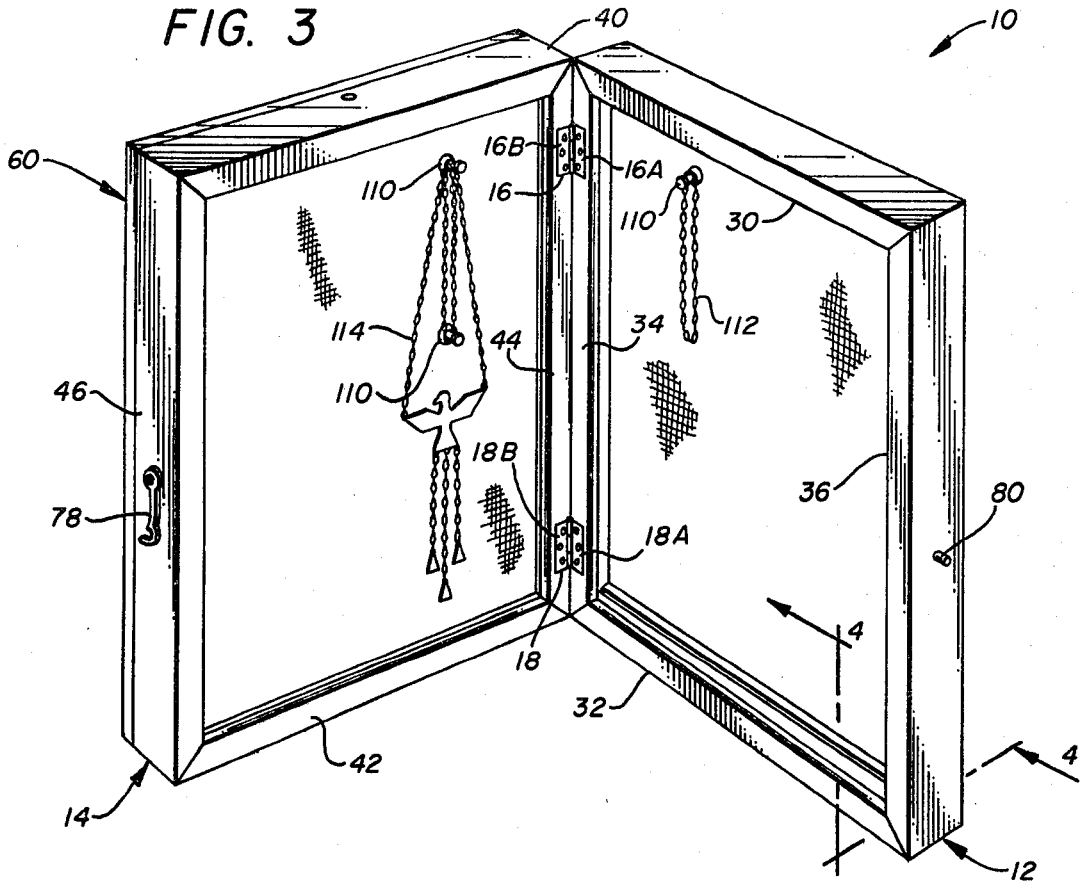
FIG. 3 is a perspective view of the invention shown in FIG. 1 with the jewelry box in an open position.

As best seen in FIGS. 1-3, container 12 is adapted to enclose jewelry and includes a base 20 composed of a first board 22 of relatively hard material, a second board 24 of a material not as hard as the material in first board 22, a third board 26 of a material not as hard as the material in second board 24, and a cover 28, which is made of a material chosen to enhance the appearance of the interior of container 12, such as velvet. Disposed around the periphery of and extending outwardly from base 20 are upper container side wall 30, lower container side wall 32, left container side wall 34, and right container side wall 36. Container side walls 30, 32, 34 and 36 may have a generally "L" shaped cross-section so as to form a retaining lip 38 extending generally parallel to base 20.

Cover 14 is used to prevent access into container 12 and includes an upper cover side wall 40 corresponding to upper container side wall 30; a lower cover side wall 42 corresponding to lower container side wall 32; a left cover side wall 44 corresponding to left container side wall 34; and a right cover side wall 46 corresponding to right container side wall 36; and a closing wall 48. Cover side walls 40, 42, 44 and 46 are disposed about the outer periphery of closing wall 48 and may have a generally "L" shaped cross-section so as to for a retaining lip 50. As seen in FIG. 2, when cover 14 prevents access into container 12, cover side walls 40, 42, 44 and 46 extend outwardly from corresponding container side walls 30, 32, 34 and 36, respectively, and the lower extension of the "L" shaped cross-section of the cover and container side walls are in juxtaposition with one another. Closing wall 48 is composed of a first board 52 of a material similar to the material of second board 24, a second board 54 of a material similar to the material of third board 26 and a cover 56 of material similar to the material of cover 26. Closing wall 48 is disposed inwardly of the outermost edges of the cover side walls so as to form a receiving lip 58, which extends around the outer face of cover 14.

Figure 6:
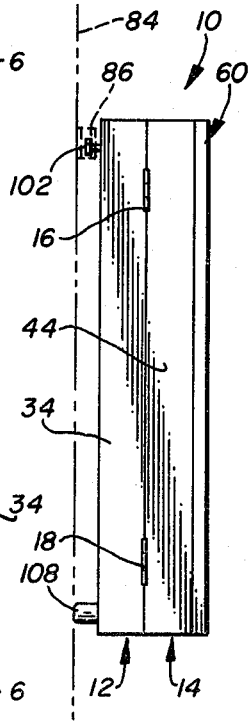
FIG. 6 is a left side elevational view of the invention shown in FIG. 5, taken along the lines 6—6 in the direction of the arrows.

As best seen in FIGS. 2, 3 and 6, upper and lower hinges 16 and 18, respectively, pivotally connect cover 14 to container 12. Hinge 16 is a jointed piece having wing members 16A and 16B with wing member 16A being attached to left container side wall 34 and with wing member 16B being attached to left cover side wall 44. Hinge 18 is a jointed piece having wing members 18A and 18B with wing member 18A being attached to left container side wall 34 and with wing member 18B being attached to left cover side wall 44.

As best seen in FIG. 1, a frame 60 is used in jewelry box 10 to provide a supporting border to a representation made on a surface, such as a photograph, painting or picture, and to permit visual observation of the representation. Frame 60 includes an upper molding 62, a lower molding 64, a left molding 66, and a right molding 68 joined to one another. A shoulder 70 is disposed on frame 60 to extend inwardly toward closing wall 48 of cover 14 and has a periphery of sufficient size to be inserted into receiving lip 58 formed on the outer face of cover 14.

An upper set screw 72 and a lower set screw 74 are respectively threadedly connected to upper side wall 40 and lower side wall 42 of cover 14 for acting against shoulder 70 on frame 60. Frame 60 is, thus, detachably connected to cover 14 to permit easy replacement of the representation made on a surface by manipulating set screws 72 and 74.

As best seen in FIGS. 1–3, jewelry box 10 further includes a latch mechanism 76 for securing cover 14 in the position preventing access into container 12. Latch mechanism 76 includes a hook member 78 rotatably connected to the exterior of cover side wall 46 and a retaining member 80 attached to the exterior of container side wall 36 for engaging the hook member 78 and thereby preventing pivotal movement of cover 14 about hinges 16 and 18.

Figure 5:
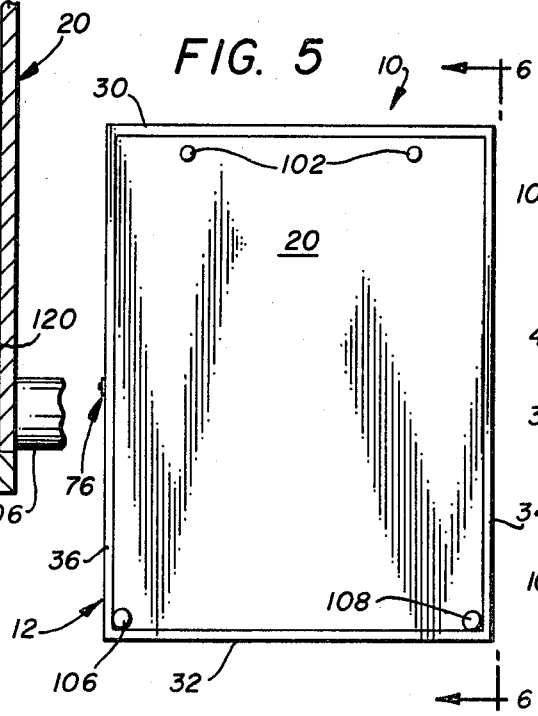
FIG. 5 is a back elevational view of the invention shown in FIG. 1.

As best seen in FIGS. 1, 5 and 6, a hanger 82 for mounting container 12 of jewelry box 10 to a wall 84 (as shown in dotted outline) is provided in close proxmity to upper container side wall 30. It has been found that hanger 82 provides stable mounting on wall 84 when hanger 82 includes a bracket 86 having first and second wall engaging portions 88 and 90, respectively, container engaging portion 92, first intermediate portion 94 connecting wall engaging portion 88 with container engaging portion 92, and second intermediate portion 96 connecting wall engaging portion 90 with container engaging portion 92. Bracket 86 is attached to wall 84 by two wall attaching members 98, such as screws, extending through an aperture 100 provided in first and second wall engaging portions 88 and 90, respectively. Bracket 86 is attached to container 12 by two container attaching members 102, such as screws, extending through slotted apertures 104 provided in container engaging portion 92.

If desired to mount base 20 in a parallel relationship with wall 84 and to further stabilize mounting container 12 on wall 84, a pad member 106 is attached to container base adjacent the junction of container side walls 32 and 36 and a second pad member 108 is attached to container base 20 adjacent the junction of container side walls 32 and 34. Pad members 106 and 108 have a length sufficient to insure the parallel relationship of base 20 with wall 84.

As best seen in FIGS. 2 and 3, jewelry box 10 includes a device 110 for suspending a necklace 112 within container 12 and for suspending a necklace 114 within cover 14. Necklace suspending device 110 is a pin member having a head 116 for engaging the necklace and a pointed end 118 for engaging container base 20 or cover closing wall 48. Thus, device 110 may be moved relative to base 20 or closing wall 48 to adjust for variations in the length of necklaces supported in container 12 or cover 14 and multiple devices 110 may be used to wrap a lengthly necklace around different heads 116, as shown for necklace 114 in FIG. 3.

The materials used in boards 24, 26, 52 and 54 are chosen to provide sufficient strength to prevent device 110 from being pulled out when a necklace is suspended from device 110 while providing sufficient elasticity to close the holes caused by removal of pointed end 118.

Figure 4:
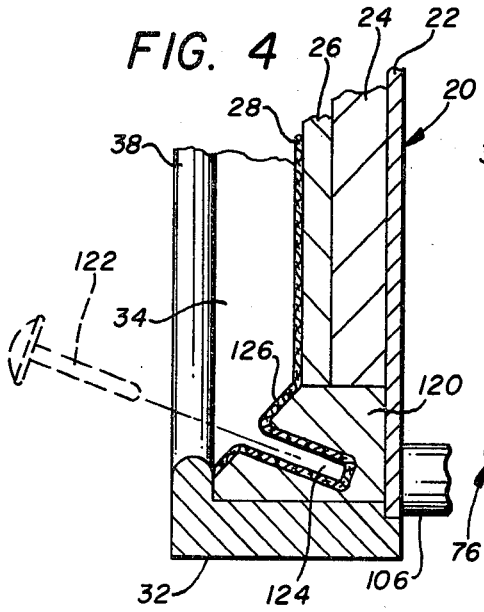
FIG. 4 is an enlarged view of a portion of the invention shown in FIG. 3, taken along the lines 4—4 in the direction of the arrows.

As best seen in FIGS. 3 and 4, a member 120 for supporting a ring 122 (shown in dotted outline) may be disposed in container 12 to extend adjacent and along lower container side wall 32. Ring support member 120 includes a slot 124 to receive a portion of ring 122 and a cover 126 made of a material similar to the material used in cover 28. Slot 124 is disposed in member 120 to angle away from base 20 of container 12 so that the weight of ring 122 will maintain the ring's position in ring gupport member 120. This angle is optimum when first board 22 and slot 124 subtends an angle of 60°.

The invention having been described, what is claimed is:

1. A jewelry box, comprising: container means adapted to enclose jewelry; cover means for preventing access into said container means; means for connecting said cover means to said container means; frame means for providing a supporting border to a representation made on a surface and for permitting a visual observation of the representation; and attaching means for detachably connecting said frame means to said cover means to permit replacement of the representation.

2. A jewelry box as set forth in claim 1, wherein said cover connecting means includes hinge means for pivotally connecting said cover means to said container means.

3. A jewelry box as set forth in claim 1, wherein said container means includes a base and container side walls extending outwardly from the base; wherein said cover means includes a cover side wall for each container side wall and a closing wall connecting the cover side walls to one another; and wherein said cover connecting means includes hinge means connecting a single cover side wall to a corresponding single container side wall for pivotally moving said cover means between a position permitting access into said container means and a position preventing access into said container means, the cover side walls being disposed to extend outwardly from the container side walls when said cover means is disposed in the access preventing position.

4. A jewelry box as set forth in claim 1, including means for securing said cover means in a position preventing access into said container means.

5. A jewelry box as set forth in claim 1, including hanger means for mounting said container means on a wall.

6. A jewelry box as set forth in claim 5, including means for suspending a necklace within said container means when mounted on the wall.

7. A jewelry box as set forth in claim 6, wherein said necklace suspending means includes a pin member adapted to be detachably connected to a base of said container means so that the pin member may be moved to adjust for variations in the length of necklaces being supported in said container means.

8. A jewelry box as set forth in claim 1, including means for supporting jewelry within said cover means.

9. A jewelry box, comprising: container means; cover means for preventing access into said container means;

means for controlling said cover means to said container means; hanger means adapted to be connected to said container means for mounting said container means on a wall; and means for suspending a necklace within said container means when said container means is mounted on the wall.

10. A jewelry box as set forth in claim 9, wherein said cover connecting means includes hinge means for pivotally connecting said cover means to said container means.

11. A jewelry box as set forth in claim 9, wherein said container means includes a base and container side walls extending outwardly from the base; wherein said cover means includes a cover side wall for each container side wall and a closing wall connecting the cover side walls to one another; and wherein said cover connecting means includes hinge means connecting a single cover side wall to a corresponding single container side wall for pivotally moving said cover means between a position permitting access into said container means and a position preventing access into said container means, the cover side walls being disposed to extend outwardly from the container side walls when said cover means is disposed in the access preventing position.

12. A jewelry box as set forth in claim 9, including means for securing said cover means in a position preventing access into said container means.

13. A jewelry box as set forth in claim 9, wherein said necklace suspending means includes a pin member adapted to be detachably connected to a base of said container means so that the pin member may be moved to adjust for variations in the length of necklaces being supported in said container means.

14. A jewelry box as set forth in claim 9, including means for supporting a ring within said container means.

15. A jewelry box as set forth in claim 9, including means for suspending a necklace within said cover means.

16. A jewelry box, comprising: container means for supporting jewelry including a base and container side walls extending outwardly and around the periphery of the base; cover means for preventing access into said container means including a cover side wall for each container side wall and a closing wall connecting the cover side walls to one another; hinge means connecting one cover side wall to a corresponding container side wall for pivotally moving said cover means between a position permitting access into said container means and a position preventing access into said container means, the cover side walls being disposed to extend outwardly from the container side walls when said cover means prevents access into said container means; means for securing said cover means in the position preventing access into said container means; frame means for providing a supporting border to a representation made on a surface and for permitting visual observation of the representation; attaching means for detachably connecting said frame means to said cover means to permit replacement of the representation; hanger means adapted to be connected to an upper portion of the base of said container means for mounting said container means on a wall; means for suspending a necklace within said cover means including a pin member adapted to be detachably connected to the closing wall of said cover means so that the pin member may be moved to permit adjustment for variations in the length of necklaces being supported in said cover means; means for suspending a necklace within said container means including a pin member adapted to be detachably connected to the base of said container means to that the pin member may be moved to permit adjustment for variations in the length of necklaces being supported in said container means, and a ring support member disposed within said container means adjacent a container side wall, the ring support member having a slot adapted to receive a portion of the ring, the slot being diposed to angle away from the base of said container means so that the weight of the ring will maintain the ring position in the ring support member.

* * * * *